United States Patent [19]

Varga et al.

[11] Patent Number: 4,777,700

[45] Date of Patent: Oct. 18, 1988

[54] CARDING MACHINE

[75] Inventors: John M. J. Varga, Halifax; Christopher H. Marshall, Southport, both of England

[73] Assignee: Carding Specialists (Canada) Ltd., Toronto, Canada

[21] Appl. No.: 57,496

[22] Filed: Jun. 3, 1987

[30] Foreign Application Priority Data

Jun. 4, 1986 [GB] United Kingdom ..... 8613540

[51] Int. Cl.[4] ..... D01G 15/20

[52] U.S. Cl. ..... 19/105; 19/107

[58] Field of Search ..... 19/105, 107

[56] References Cited

U.S. PATENT DOCUMENTS

| | | | |
|---|---|---|---|
| 442,936 | 12/1890 | Ashworth | 19/105 |
| 1,558,414 | 10/1925 | Thoma | 19/105 |
| 1,559,475 | 10/1925 | Thoma | 19/105 |
| 3,205,537 | 9/1965 | Reiterer | 19/105 X |

FOREIGN PATENT DOCUMENTS

| | | | |
|---|---|---|---|
| 1225082 | 9/1966 | Fed. Rep. of Germany | 19/105 |
| 1510473 | 11/1969 | Fed. Rep. of Germany | 19/105 |
| 0000849 | of 1912 | United Kingdom | 19/105 |

*Primary Examiner*—Louis K. Rimrodt

*Attorney, Agent, or Firm*—Henry Sternberg; Bert J. Lewen

[57] ABSTRACT

A carding machine has a toothed takerin (4a) for taking fibre to be carded from a feed arrangement (3a) to a main carding cylinder (5a). The fibre is conveyed on the lower arc of the takerin, and a substantially rigid, flat plate (10) lies below the lower arc of the takerin. The plate extends across the full width of the takerin and terminates in a free edge facing into the direction of roation of the takerin and substantially parallel to the takerin axis. The free edge is spaced from the tips of the teeth on the takerin by a distance of not more than 5 mm, and the plate lies in a plane that makes an angle of from 75° to 120° to that radial plane of the takerin that intersects the free edge of the plate.

10 Claims, 2 Drawing Sheets

CARDING MACHINE

Figure 1:
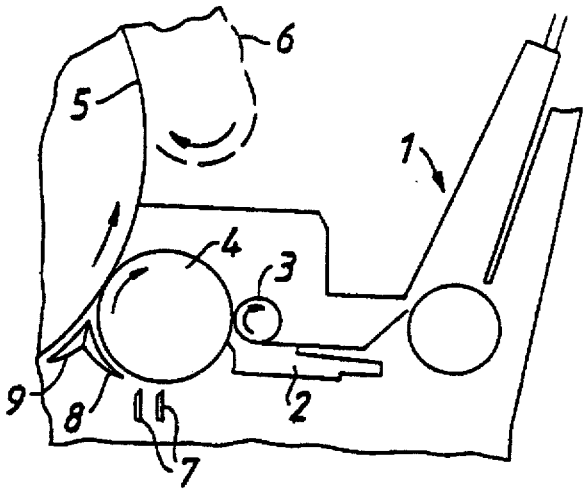

This invention relates to carding machines.

One function of the carding process is to remove as much trash and dust from the feed stock as possible in order that the sliver resulting from the carding process will be as clean as possible and can be spun into a yarn of correspondingly high quality. There are many regions on the conventional carding machine where cleaning is effected. One of these is on the lower arc of the takerin as feed stock is transferred on that roller from the feed plate to the main carding cylinder. The usual cleaning arrangement in this region of the carding machine is the mounting of one or more mote knives adjacent to the lower arc of the takerin. Any mote knife that is so located extends in a plane that is substantially diametrical relative to the takerin and terminates in an edge located close to the takerin. The mote knives are effective in removing a certain amount of trash and dust from the feed stock carried by the takerin.

US-A-1558414 discloses what may be considered as a profiled mote knife or a deviating plate located below the takerin, the plate having working surfaces defined by two parabolas that join a free edge of the plate and diverge from that edge, at the same time extending away from the takerin at a substantial angle to the circumference thereof. The free edge of this plate faces into the direction of rotation of the takerin and is set approximately 0.125 mm from the tips of the teeth on the takerin, the objective being to divert airflow from the takerin, surface in a smooth fashion. The diverted airflow carries with it trash and dust, but it also carries a large amount of lint and short fibre capable of being incorporated into the eventually carded web without significant deleterious effect on the quality of that web. Visually, this is readily apparent by a simple inspection of the undercard droppings in the takerin region, with white lint appearing as the pricipal constituent of these droppings.

The purpose of the present invention is to improve the cleaning action in the takerin region of a carding machine, while promoting the retention of lint and short fibre to a required degree.

According to the invention a carding machine comprises a feed arrangement, a toothed takerin for taking fibre to be carded from the feed arrangement, and a main carding cylinder downstream of the takerin, the arrangement being such that fibre is conveyed on a lower arc of the takerin from the feed arrangement to the main carding cylinder, in which a substantially rigid, flat plate lies below the lower arc of the takerin, the plate extending across the full width of the takerin and terminating in a free edge facing into the direction of rotation of the takerin, the free edge being substantially parallel to the axis of the takerin and being spaced from the tips of the teeth on the takerin by a distance of not more than 5 mm and the plate lying in a plane that makes an angle of from 75° to 120° to that radial plane of the takerin that intersects the free edge of the plate.

Most surprisingly, it has been found that the arrangement of a single flat plate in accordance with the invention significantly improves the cleaning effect in the takerin region of the carding machine Visual inspection indicates that a higher trash/lint ratio in the undercard droppings below the takerin is attainable, and analysis of sliver leaving the carding machine indicates higher overall cleaning efficiency. This increase in overall cleaning without increasing, and indeed even decreasing, the amount of potentially usable fibre that is taken from the feed stock in the takerin area is a most unexpected result.

Preferably the spacing of the free edge of the plate from the tips of the teeth on the takerin is from 0.25 to 2.5 mm, and more desirably from 0.5 to 2 mm. It has been found that in some cases the amount of trash removed increases as the spacing between the free edge of the plate and the tips of the teeth on the takerin reduces, but lint removal also increases. The optimum setting can readily be determined empirically for a given feed stock and a given set of carding conditions.

The length of the plate measured in the direction of rotation is desirably at least 15 mm, and preferably in the range of 22 to 50 mm, within which range the cleaning effect can generally be optimised. A plate of this length will subtend an angle at the centre of a standard 25.4 cm diameter takerin of at least 7°, preferably 10° to 24°. The plate desirably has an aspect ratio of at least 10:1, i.e. it is thin in relation to its length. Desirably the plate lies in a plane that makes an angle of from 95° to 110° to the aforesaid radial plane, and more preferably from 90° to 100°.

The position of the plate in relation to the downstream end of the feed arrangement can be varied, but desirably it is such that the angle subtended at the centre of the takerin by that arc of the takerin which extends from the downstream end of the feed arrangement to the free edge of the plate in the direction of rotation is from 30° to 45°.

The importance of increasing the removal efficiency of trash and dust while retaining as much usable lint and short fibre as possible has already been emphasised. Surprisingly, it has been found that the retention effect can be enhanced without deleterious effect on trash removal if a mote knife is arranged immediately downstream of the plate. The operation of such a mote knife in combination with the plate is not clear. Two effects may be operating, firstly the mote knife acting as a physical barrier which prevents blow-out of lint and short fibre immediately downstream of the plate, and secondly the generation of back pressure between the plate and the takerin that promotes the blowout of more trash at the edge of the plate, without a commensurate increase in lint blowout.

Conveniently the plate may be mounted on the mote knife for adjustment relative thereto. Alternatively, the plate and the mote knife may be separately mounted on the carding machine for independent adjustment, relative to the takerin. Provision of both plate and mote knife, with relative adjustment therebetween is thought to allow for the first time a properly controllable cleaning region on the takerin that is easy to set for any given feed stock in order to obtain a required balance between cleaning and fibre retention.

It is presently thought that either one or two plates will be mounted adjacent to the lower arc of the takerin and that either or both of such plates will have an associated mote knife immediately downstream thereof. However, the use of more than two such plates, with or without associated mote knives is not excluded.

The arc of the takerin that lies between the downstream extremity of the plate and/or mote knife and the main carding cylinder may be covered by any conventional grid or screen arrangement.

The cleaning arrangement of the invention will generally be employed on the takerin that lies between a conventional feed roller and feed plate of a single cylinder card, or the feed plate that introduces material to the takerin of the first or breaker cylinder of a duocard. However, the arrangement can also be used in conjunction with the takerin for the finisher cylinder of a duocard, and in this case the feed arrangement will be constituted by the transfer rollers and/or other web handling devices in the centre section of the duo-card.

Figure 2:
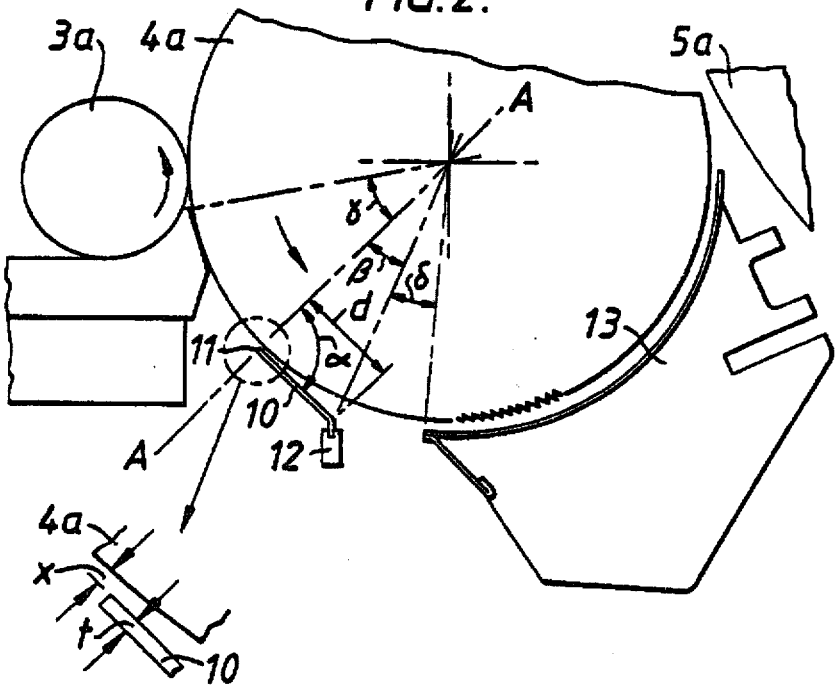
Figure 3:
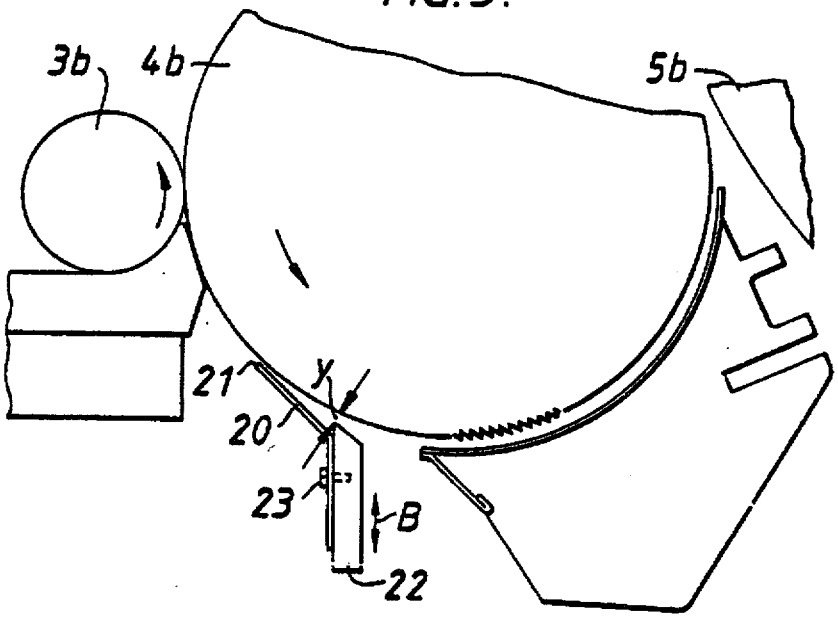
Figure 4:
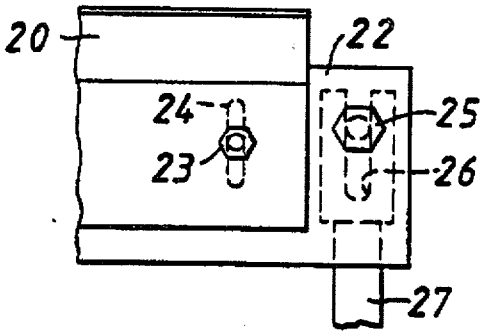

The invention will be better understood from the following description given in conjunction with the accompanying drawings in which:

FIG. 1 is a schematic side elevation of the feed region of a conventional carding machine, and illustrates a prior art mote knife arrangement;

FIGS. 2, 2*a* and 3 are elevations of part of the feed region of a carding machine, showing two alternative arrangements according to the invention; and FIG. 4 is a partial view in the direction of the arrow A of FIG. 3.

Referring to FIG. 1 there is shown part of a prior art carding machine having a chute feed arrangement 1, a feed plate 2, a feed roller 3 cooperating with the feed plate, a takerin 4, a main carding cylinder 5 and a set of rotating flats 6. The feed roller conveys feed stock from the feed plate 2 to the main carding cylinder 5 along the lower arc of the takerin, and positioned adjacent to this lower arc there are two mote knives 7. A takerin screen 8 is mounted in the region between the takerin and the main carding cylinder, and abuts a cylinder screen 9. It will be seen that each of the mote knives 7 extends substantially diametrically of the takerin and terminates in a free edge that is substantially at right angles to the direction of rotation of the takerin. The mote knives act to divert trash and dust from the fibres carried by the takerin, but their efficiency is generally recognised as being limited, and they are also prone to removing lint and short fibre that could advantageously be incorporated into the finally carded web.

FIG. 2 shows part of a carding machine similar to that shown in FIG. 1, but modified in accordance with a first embodiment of the invention. In this embodiment, the mote knives are replaced by a substantially rigid, flat plate 10 which extends across the full width of the takerin 4*a*, downstream of the feed roller 3*a*, and which terminates in a free edge 11 that is substantially parallel to the axis of the takerin and that faces into the direction of rotation of the takerin. The plate may suitably be metal sheeting, the sheeting having a thickness t of from 1 to 3 mm, with 1.5875 mm sheet presently preferred, see FIG. 2*a*. The plate is supported by a support bar 12 which extends the full width of the carding machine and is mounted between the side frame members of the carding machine. The plate is followed in the downstream direction by a takerin screen 13, extending to the region of co-operation between the takerin and the main carding cylinder 5*a*. The free edge 11 of the plate is spaced from the tips of the teeth on the takerin by a distance x of not more than 19.5 mm, preferably 0.25 to 5.0 mm; and the plate lies in a plane that makes an angle $\alpha$ of from 75° to 120° to a plane A—A radial of the takerin and intersecting the free edge of the plate. This corresponds to an angle between the plane of the plate and a plane tangential to the takerin at that region of the takerin which lies closest to the free edge of the plate of not more than 30° where the plate initially diverges from its free edge away from the takerin, and of not more than 15° where the plate initially converges from its free edge towards the takerin. The length d of the plate in the direction of rotation is at least 15 mm, preferably from 22 to 50 mm. The preferred aspect ratio (d/t) of the plate is from 13 to 30. It will be appreciated that the working edge 11 of the plate 10 is in a completely different relationship to the takerin than are the working edges of the mote knives 7, and that the aerodynamic effect of the plate is totally different to that of earlier takerin cleaning arrangements. Surprisingly, it has been found that the arrangement of the invention can improve the cleaning efficiency on the takerin by up to some ten per cent, and that the ratio of lint to trash in the undercard droppings below the takerin can be reduced, i.e. more usable fibre is retained.

In a preferred arrangement as shown in FIG. 2 the radial spacing x between the free edge 11 of the plate 10 and the tips of the teeth on the takerin may be from 0.5 to 2.0 mm. The angle $\alpha$ between the plate and the radial plane A—A is from 90° to 100°. The length d of the plate in the direction of rotation is from 30 to 45 mm, with the plate subtending an angle $\beta$ at the centre of a takerin of standard 25.4 cm diameter of from 13° to 21°. The angle $\gamma$ subtended at the centre of the takerin from the nose of the feed plate 2 to the free edge 11 of the plate 10 may preferably be from 30° to 40°. The angle $\delta$ between the trailing edge of the plate 10 and the leading edge of the takerin screen 8 may preferably be from 10° to 30°. Each of the aforesaid variables may be determined empirically to suit a given feed stock and set of carding conditions, and it is preferred, therefore, that the mounting bar 12 be supported on the side plates of the carding machine in such a way that it may be adjusted to allow variation of the various angles, and also to allow variation of the spacing between the free edge 11 and the tips of the teeth on the takerin. Suitable adjusting arrangements will readily be apparent. In certain cases it may be possible to eliminate the need for the takerin screen 8.

As well as removing trash, dust and short fibre, which will generally be carried away by the conventional card suction cleaning system, some lint will also be removed by the plate 10, and there is a possibility that removed material may accumulate on the surface of the support bar 12 and in the space between the plate 10 and the screen 13. It will usually be preferred that such accumulation is either constantly or periodically removed, and a suitable method of effecting this would be to mount a blower adjacent to the mounting bar 12 so that a stream of air is directed across the surface thereof in order to blow off accumulated material.

FIG. 3 shows an alternative embodiment wherein a feed roller 3*b* feeds a takerin 4*b* having associated therewith a plate 20, again extending the full width of the takerin and having a free edge 21 facing into the direction of rotation. The plate is adjustably supported on the front face of a conventional mote knife 22 by way of bolts 23 and slots 24 at each side of the carding machine. The mote knife in itself adjustably mounted on the frame of the carding machine by bolts 25 engaging slots 26 in brackets 27 secured to the frame, so that the mote knife can be adjusted towards and away from the takerin as indicated by double arrow B.

In this embodiment, the preferred dimensions of, and settings for, the plate 20 are as described for the plate 10 shown in FIG. 2. Additionally, the spacing y of the mote knife from the tips of the teeth on the takerin, is preferably from 0.25 to 5 mm. Correct selection of plate length d, and correct settings of the distances x and y from the tips of the takerin teeth to the edge of the plate and to the mote knife can, for a given feedstock, be arrived at empirically within the limits taught herein, to give a takerin cleaning arrangement that will effect good trash removal without removing large quantities of usable lint and short fibre. Indeed, results obtained using the combination of a plate and a mote knife will usually be better than those obtained using a plate alone. Furthermore, the presence of the mote knife reduces or eliminates the accumulation of removed material between the plate and the screen.

It will be apparent that modifications can be made to the embodiments that have been particularly described. For example, two or more plates may be associated with the takerin, spaced apart circumferentially around the takerin and each independently adjustable. Any such plate may be mounted on an associated mote knife. The takerin screen may be omitted when a plurality of plates are provided.

When a plate has an associated mote knife it is clearly convenient to mount the plate on the mote knife, but independent mountings for the plate and the mote knife could be used if so desired.

Plate material may be varied, and plate thickness need not be uniform throughout, although thickness variations should not be large.

We claim:

1. A carding machine comprising a feed arrangement, a toothed takerin for taking fibre to be carded from the feed arrangement, and a main carding cylinder downstream of the takerin, the arrangement being such that fibre is conveyed on a lower arc of the takerin from the feed arrangement to the main carding cylinder, in which a substantially rigid, flat plate extends below the lower arc of the takerin, the plate extending across the full width of the takerin and terminating in a free edge facing into the direction of rotation of the takerin, the free edge being substantially parallel to the axis of the takerin and being spaced from the tips of the teeth on the takerin by a distance of not more than 5 mm, and the plate lying in a plane that makes an angle of from 75° to 120° to that radial plane of the takerin that intersects the free edge of the plate.

2. A carding machine according to claim 1 in which the spacing of the free edge of the plate from the tips of the teeth on the takerin is from 0.25 to 2.5 mm.

3. A carding machine according to claim 2 in which the length of the plate measured in the direction of rotation is at least 15 mm.

4. A carding machine according to claim 3 in which the length of the plate measured in the direction of rotation is from 22 to 50 mm.

5. A carding machine according to claim 1 in which the plate has an aspect ratio of at least 10:1.

6. A carding machine according to claim 1 in which the plate lies in a plane that makes an angle of from 95° to 110° to the aforesaid radial plane.

7. A carding machine according to claim 1 in which the angle subtended at the centre of the takerin by that arc of the takerin which extends from the downstream end of the feed arrangement to the free edge of the plate in the direction of rotation is from 30° to 45°.

8. A carding machine according to claim 1 in which a mote knife is arranged immediately downstream of the plate.

9. A carding machine according to claim 8 in which the plate is mounted on the mote knife for adjustment relative thereto.

10. A carding machine according to claim 8 in which the plate and the mote knife are mounted for separate adjustment relative to the teeth on the takerin.

* * * * *